US005267728A

United States Patent [19]

Simeth

[11] Patent Number: 5,267,728

[45] Date of Patent: Dec. 7, 1993

[54] MEANS FOR MONITORING THE SIDE LAYS AND MASKING OR EXCESS DRAW OF A SHEET-FED ROTARY PRESS

[75] Inventor: Claus Simeth, Geisenheim, Fed. Rep. of Germany

[73] Assignee: MAN Roland Druckmaschinen AG, Fed. Rep. of Germany

[21] Appl. No.: 885,302

[22] Filed: May 18, 1992

[30] Foreign Application Priority Data

May 18, 1991 [DE] Fed. Rep. of Germany ..... 4116409

[51] Int. Cl.[5] ..... B65H 9/00

[52] U.S. Cl. ..... 271/228; 271/236; 271/245; 271/250; 271/253

[58] Field of Search ..... 271/236, 250, 252, 228, 271/227, 248, 245, 234, 253, 254

[56] References Cited

U.S. PATENT DOCUMENTS 3,743,277 7/1973 Bolza-Schunemann .
4,613,125 9/1986 Jeschke .
5,072,926 12/1991 Van Soest ..... 271/227 X

FOREIGN PATENT DOCUMENTS 617108 7/1935 Fed. Rep. of Germany ..... 271/236
2137661 2/1973 Fed. Rep. of Germany ..... 271/250

*Primary Examiner*—David H. Bollinger
*Attorney, Agent, or Firm*—Leydig, Voit & Mayer

[57] ABSTRACT

A device for monitoring the side lay marks and excess draw of a sheet fed rotary press that further ensures that sheets are at a sufficient distance from the side lay mark prior to transverse conveyance. A lateral sensor is positioned at a predetermined distance from the side lay mark so that when front sensors determine the presence of a sheet at front lay marks, the lateral sensor is evaluated. The sheet will only be conveyed transversely toward the side lay if the lateral sensor has not detected a sheet but the front sensors have, thus ensuring that the side edge of the sheet is at a sufficient distance from the side lay mark. A single sensor can also be used for all side lay mark monitoring, including monitoring for excess draw.

11 Claims, 2 Drawing Sheets

MEANS FOR MONITORING THE SIDE LAYS AND MASKING OR EXCESS DRAW OF A SHEET-FED ROTARY PRESS

FIELD OF THE INVENTION

The invention relates generally to sheet-fed printing presses, and more particularly to a device for monitoring sheet movement near the side lay mark for excess draw-over and proper sheet alignment.

BACKGROUND OF THE INVENTION

When sheets are fed to a rotary press, proper feeding requires that the sheets first be aligned. In typical feeding systems, sheets are fed onto a feed table, and then conveyed forward to a set of front lay marks, or abutments. If the front edge of the sheet is properly aligned on the front lay marks, the sheets are then traversely conveyed to a side lay mark, or lateral abutment, so that the left edge of the sheet (or alternatively the right edge) becomes correctly aligned. Once the front and side edges are in proper alignment, the lay marks are moved out of the way and the sheet is then supplied to the press. One such system is described in German patent specification 1,561,015. While the various forms of mechanical side lay mechanisms are known in the art, to the extent necessary the disclosure of said German specification is hereby incorporated by reference.

The known means for detecting if a sheet is properly on the lay marks is to use sensors located near the lay marks, so that when a sheet should be in alignment, a control unit reads the appropriate sensor or sensors and thereby evaluates the sheet position. Further steps in the sheet feeding procedure, (e.g., transverse conveyance) depend on the outcome of the evaluations.

Typically, the sensors are optical reflection sensors which operate in a known manner to detect the presence or absence of a sheet. For example, the sensors operate by optical reflection so that when a sheet passes underneath a light source the sheet reflects light to the sensor, thereby indicating its presence.

In addition to sensing for proper alignment, a sheet can also be sensed earlier, during its forward conveyance, (i.e., toward the front lay marks) to ensure that the sheet will not interfere with the returning lateral abutment. For example, if the sheet is so far left that its left edge is moving below the abutment, the return of the abutment will jam the sheet. This condition is known as excess draw, or draw-over.

The conventional way to monitor for draw-over is to position a first lateral sensor on the outside of the lateral abutment, that is, at a location where the side edge of the sheet should not extend beyond during its forward conveyance. If this first lateral detector detects a sheet, the control unit takes corrective measures such as halting the drive to prevent improper sheet conveyance.

In these conventional systems, a second sensor is employed to detect and control proper side lay mark alignment. Thus a second lateral sensor is located inside the side abutment to detect proper side edge alignment. This is not the same lateral sensor that monitors for draw-over of the sheet, but a sensor for side lay mark monitoring. When this second sensor detects the presence of a sheet, it actuates the transverse conveyor to convey the sheet toward the lateral side lay abutment. The front sheet sensors are thereafter actuated by the leading edge of the sheet to signal that the sheet has been properly fed.

However, this known system of side lay mark monitoring suffers from a particular problem when the sheet is too near the lateral abutment after forward conveyance, although not far enough to have been in a draw-over condition. When this occurs, the sheet cannot make any appreciable lateral movement. Often, however, some lateral movement is necessary to correct alignment of a slightly skewed sheet. Thus, if a slightly skewed sheet is too close to the lateral abutment, deformation (crushing) of the sheet occurs because the transverse conveyor applies a force to the sheet at a time when the sheet cannot move far enough in the transverse direction to correct itself.

SUMMARY OF THE INVENTION

It is therefore an object of the invention to provide a device that monitors both lateral alignment and excess draw over, while further ensuring that the sheet is not incorrectly forced into the lateral abutment during transverse conveyance.

Briefly, the present invention provides a device that ensures sufficient distance for lateral conveyance of a sheet while still monitoring for draw-over and proper side edge alignment. This is accomplished by setting a minimum gap, in the example by disposing a sensor at a distance from the lateral abutment that is at about the minimum distance necessary for corrective lateral sheet movement. The control unit monitors both the front sensors and the side lay sensors. It activates the transverse conveyor when a sheet is detected by the front sensor arrangement but not by the side lay sensor to assure that the sheet is displaced from the lateral abutment by a distance greater than the minimum gap. If a sheet is detected as being within the gap, however, feeding is stopped and corrective action is taken by the control unit. For example, sheet conveyance can be halted, or alternatively the sheet could be conveyed away from the lateral abutment until its edge no longer extends into the gap.

Thus, an important feature of the invention is the simultaneous evaluation of the front and lateral sensors so that the commencing of lateral conveyance depends both on the presence of a sheet at the front abutment and the absence of any part of a sheet at a predetermined distance from the side abutment.

It is a feature of the invention that side lay control is effected not only by the side lay sensor, but also in cooperation with the front lay sensors. Thus, the front lay sensors are used to determine the disposition of a sheet, and only after that detection is the transverse conveyor activated, and then only if the side lay sensor does *not* detect the presence of a sheet. Thus, the presence of a sheet is detected by the front lay sensors while the side lay sensor determines only that the sheet is displaced from the side lay sensor by at least the minimum gap so that the transverse conveyor will not damage the sheet. When those two conditions are concurrently met, the transverse conveyor is activated to bring the sheet to the side lay abutment, thus assuring proper sheet position, and without damage to the edges of the sheet. The draw-over sensor can, of course, be active at all times, whether or not the front lay sensors are active, since a sheet interfering with that sensor should immediately trigger a control action.

In a first embodiment, two side lay sensors are employed. One is for sensing the minimum gap, and the other is for monitoring for excess draw-over. In an alternative embodiment, a single sensor can be used for draw-over monitoring, monitoring of the lateral alignment, and for sensing the minimum gap prior to transverse conveyance.

Other objects and advantages of the present invention will become apparent upon consideration of the following detailed description when taken in conjunction with the drawings.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention as defined by the appended claims.

DETAILED DESCRIPTION OF THE PREFERRED EMBODIMENT

Figure 1:
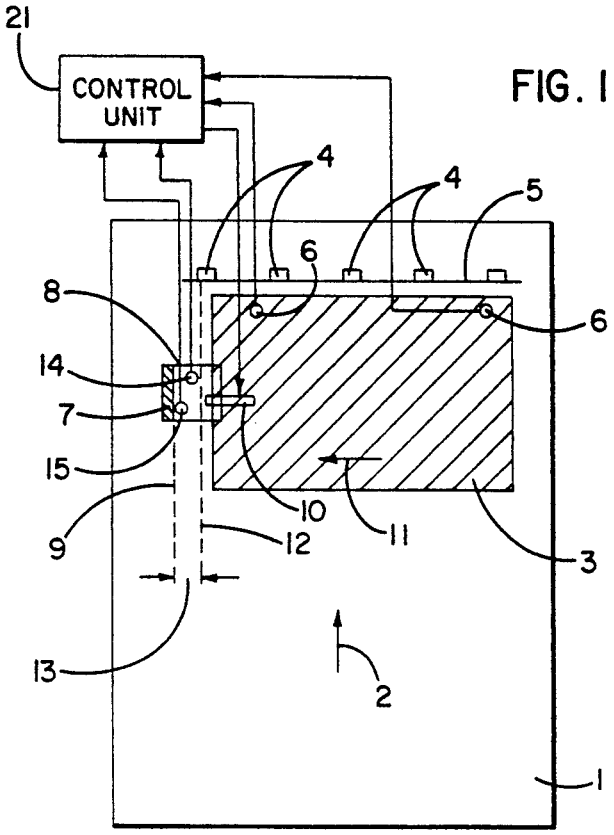
FIG. 1 is a plan view of a sheet lying on a feed table prior to transverse conveyance.

FIG. 1 shows a feed table 1 on which at least one sheet 3 has been conveyed forward in the direction indicated by an arrow 2. The sheets 3 typically are fed onto the feed table from a separate feeder of a known design (not shown). At the forward end of the feed table 1 is the front lay mark which includes front abutments 4 secured to a register gauge 5. The sheet 3 is shown as being substantially in contact with register gauge 5 of the front lay mark.

Sensors 6 detect the presence of sheet 3 and convey signals representative of the presence of the sheet 3 to a control unit 21. Sensors 14 and 15 also transmit signals to control unit 21 if sheet 3 extends over any portion of the area covered by them. The sensors 6, 14 and 15 can be of a type that transmit signals proportional to the amount of area covered by sheet 3, however, sensors that merely detect the presence of absence of a sheet may also be used.

Sensor 14 is positioned so that it will begin to detect the presence of a sheet 3 if its side edge is within a minimum distance to the contact surface 9 of lateral abutment 7. Imaginary line 12 depicts this minimum distance, and extends parallel to contact surface 9. Together, both define a gap 13 so that sensor 14 detects the presence of a sheet 3 whenever the side of the sheet 3 extends into gap 13.

Figure 2:
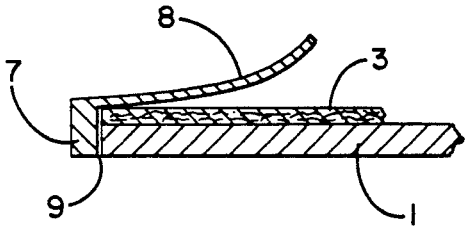
FIG. 2 is an end view of a sheet aligned with a side lay mark while lying upon the feed table.

The control unit 21 evaluates the sensors 6 and sensor 14 so that when a sheet is present at the front lay mark as detected by sensor 6, but is not present in gap 13 as detected by sensor 14, the control unit 21 activates transverse conveyor 10. Transverse conveyor 10 moves the sheet 3 in the direction indicated by arrow 11 under a guide plate 8 until the edge of the sheet 3 reaches contact surface 9 of lateral abutment 7. FIG. 2 shows the sheet 3, supported by feed table 1, aligned against contact surface 9 of lateral abutment 7. Guide plate 8 is also shown. At this time, sheet 3 is properly aligned both on the front lay mark (register gauge 5 and front abutments 4) and the side lay mark (lateral abutment 7 having contact surface 9), and the sheet is further fed to a rotary press (not shown) in a known manner.

If, however, the sheet 3 was detected as being within the gap 13, the control unit 21 would take corrective action. Such action could include halting all sheet movement until the problem was manually corrected, or automatically operating the transverse conveyor 10 so that the sheet 3 is moved away from lateral abutment 7 until the sheet 3 no longer extended into the gap 13.

Sensor 15 is used to monitor for excess draw. It is adjacent to lateral abutment 7 so that if it detects sheet 3 during the forward conveyance of the sheet, there is a chance of sheet 3 interfering with the lateral abutment 7. If sensor 15 detects the sheet, corrective action can be taken such as halting the feeding until the sheet is corrected.

Figure 3:
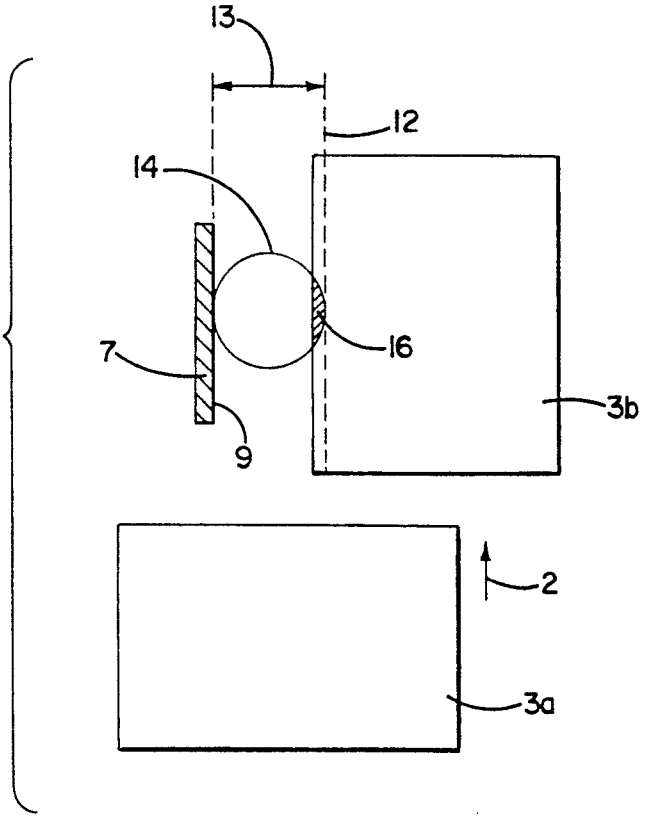
FIG. 3 is a plan view showing two incorrect sheet feed possibilities relative to the side lay mark having a single sensor.

FIG. 3 shows an embodiment of the invention using a single sensor 14 rather than the dual sensor arrangement of FIG. 1. Single sensor 14 occupies at least the entire gap 13, with one side tangent to contact surface 9 of lateral abutment 7 and the other tangent to imaginary line 12. Single sensor 14 must be able to produce a signal that is proportional to the area covered by the sheet 3. The sensor 14 can be an optical reflection sensor, whereby the amplitude of the signal produced is directly proportional to the area covered. Alternatively, the sheet 3 could interrupt a beam of light from a source to a sensor, whereby the amplitude would be inversely proportional to the area covered.

FIG. 3 depicts two sheet feed errors, as shown by sheets 3*a* and 3*b*. Sheet 3*a*, moving forward in the direction indicated by arrow 2, is in the excess draw, or draw-over condition previously described. As is known, lateral abutment 7 occupies a different position (not shown) during forward conveyance of the sheets. Thus, sheet 3*a* would be struck by lateral abutment 7 when it returned, prior to side alignment, if the draw-over condition was not detected. If draw-over is detected, the forward conveyance and return of lateral abutment 7 can be halted until the sheet 3*a* is corrected.

Single sensor 14 does not move with lateral abutment 7, and thus can detect when sheet 3*a* is in the excess draw, or draw-over condition. If single sensor 14 is completely covered by a sheet, as would be the case with sheet 3*a*, the intensity of the signal produced would inform the control unit 21 of the risk of the lateral abutment 7 striking the sheet. In FIG. 1, sensor 15 would be used to sense for draw-over in a dual sensor arrangement.

In FIG. 3, sheet 3*b* depicts the condition that the present invention will now also remedy. Sheet 3*b* extends into the gap 13 defined by contact surface 9 and imaginary line 12. As in FIG. 1, imaginary line 12 is at the minimum distance from contact surface 9 which will allow a sheet to correct itself and align laterally. Sheet 3*b* is thus too close to contact surface 9 and if transversely conveyed, may be deformed (crushed) against lateral abutment 7.

However, the present invention prevents this occurrence, because the sensor 14 is positioned a minimum distance from lateral abutment 7. Thus, the sheet 3*b* covers a portion of single sensor 14. This area covered, indicated generally by 16, increases (or alternatively decreases) the amount of intensity reflected to the sensor 14 in proportion to the area covered. The control unit 21 is configured to recognize the intensity change, and therefore can handle this error in the manner previously described.

Figure 4:
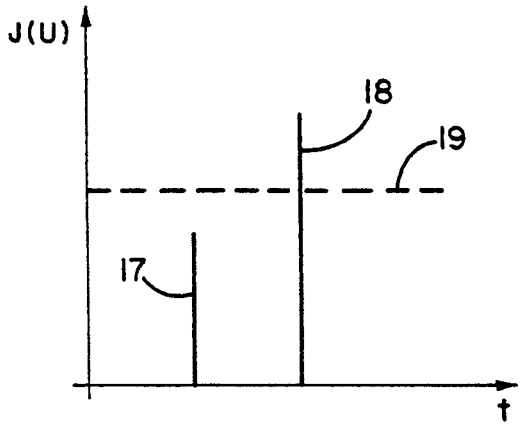
FIG. 4 is a graph showing the relative output signal intensities of a single sensor corresponding to the incorrect sheet feed possibilities of FIG. 5.
Figure 5:
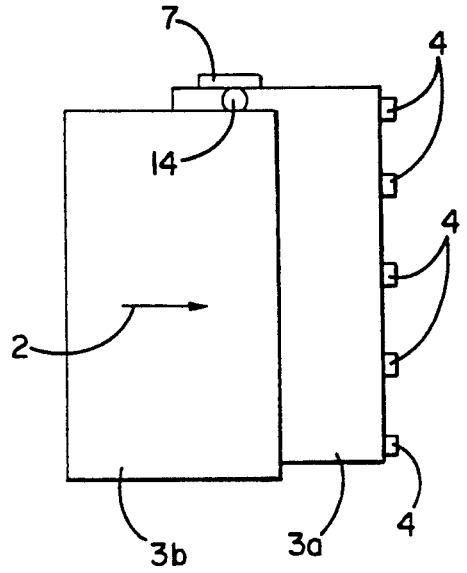
FIG. 5 shows two incorrect sheet feeds relative to a single sensor corresponding to the output signal intensities of FIG. 4.
Figure 6:
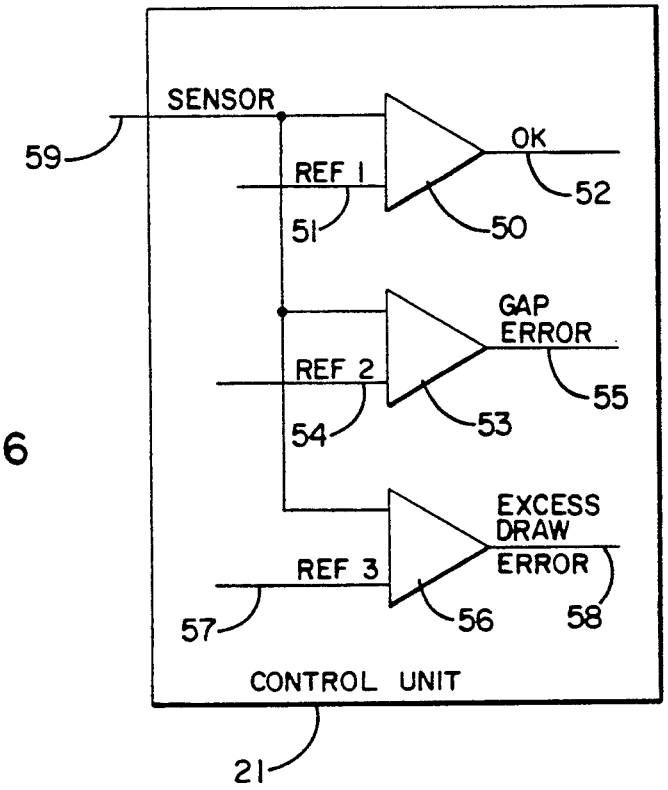
FIG. 6 shows a comparator circuit for differentiating between the output intensities of the single sensor.

Since error handling procedures may be different for excess draw-over as opposed to sheets extending into the gap 13, a simple comparator circuit (not shown) could be used to differentiate between types of errors. FIG. 5 shows sheet 3*a* in the excess draw error condition and sheet 3*b* in the minimum gap error condition. FIG. 4 shows a first intensity 17 detected as a result of sheet 3*b* extending partially over single sensor 14 of FIG. 5. FIG. 4 also shows a second intensity 18 that corresponds to single sensor 14 of FIG. 5 being fully covered, as shown by sheet 3*a*. Thus, a current or voltage comparator circuit such as shown in FIG. 6, could be used to discriminate between the two error conditions. Such a circuit could establish a threshold value 19, above which the circuit would indicate excess draw-over, while below which (but still above zero) the circuit would indicate a sheet extending into the gap 13.

Alternatively, three comparators can be monitored to differentiate between a fault condition in which a sheet edge is in the gap, a fault condition in which a sheet is in the excess drawover condition, and a condition in which the edge of the sheet is free of the gap and thus the transverse conveyor can be activated. Such a system is schematically illustrated in FIG. 6 which shows a first comparator 50 having a first reference signal 51 applied thereto, a second comparator 53 having a second reference signal 54 applied thereto, and a third comparator 56 having a third reference signal 57 applied thereto. The output of the single sensor is conveyed to the three comparators 50, 53, 56 on an input line 59.

The reference level applied to input 51 establishes a lower threshold such that when the signal from the sensor on input 59 is below the threshold, the comparator output 52 signals that there is no sheet in the gap. Thus, the comparator 50 produces an output signal 52 indicating that the system is in a mode in which the transverse conveyor will be enabled as soon as the front lay sensors detect the presence of a sheet. Thus, the signal 56 is coupled to the control circuit (by means not shown) to be combined with the front lay sensor signal for operating the transverse conveyor. By way of contrast, the second comparator 53 has a reference level 54 applied thereto such that an output signal 55 will be produced whenever the signal on sensor input 59 indicates that a sheet is present in the gap. Thus, a fault signal will be produced on output line 55 whenever corrective action is to be taken, whether that corrective action is because of an overdraw condition or a sheet in the gap. It is preferred, however, to distinguish between those two fault conditions because in the former condition it is necessary to terminate sheet feeding, whereas in the second condition it is possible to take less drastic corrective action, while still assuring that subsequent sheets will feed in a way which will allow the activation of the transverse conveyor.

Thus, a third comparator 56 can be used which has a reference level 57 applied thereto such that an output signal 58 will be produced whenever the signal on sensor input 59 indicates an overdraw condition. However, reference level 57 is such that output signal 58 will be produced only in an overdraw condition, but not when the sheet is only partially in the gap. The two fault conditions can be distinguished in this way.

The invention thus prevents the sheet from being incorrectly forced into the lateral abutment during transverse conveyance while still providing traditional monitoring functions. A single sensor can also be used to simplify the invention further.

I claim as my invention:

1. A system for monitoring the side lays of a sheet-fed rotary press, the press having a feed table for supporting sheets being fed to the press, the system comprising, in combination:

a forward abutment associated with the feed table for engaging the leading edge of sheets fed onto the feed table;

forward sensing means disposed near the forward abutment for detecting the presence of a sheet at the forward abutment and providing a signal indicative thereof;

a lateral abutment associated with the feed table;

transverse conveying means for moving the sheet on the feed table toward the lateral abutment;

lateral sensing means disposed at a predetermined distance from the lateral abutment for producing a signal when a sheet is detected, the predetermined distance establishing a gap between the lateral abutment and a line displaced therefrom by a minimum drawing distance through which the sheet can be transversely conveyed without damage;

a control unit for receiving and evaluating the signals from the forward sensing means and the lateral sensing means, the control unit including drive means for actuating the transverse conveyer when the forward sensing means detects the presence of a sheet and concurrently the lateral sensing means detects the absence of a sheet.

2. A system for monitoring the side lays according to claim 1 further comprising:

excess draw sensing means adjacent to the lateral abutment for monitoring the sheet during its forward movement and providing an excess draw alarm signal indicative of the presence of the sheet, the control unit disabling the feeding of the sheet upon receiving an excess draw alarm signal.

3. A system for monitoring the side lays according to claim 2 wherein the lateral sensing means and excess draw sensing means include and are responsive to a single sensor disposed to sense substantially the entire gap to produce an output signal having a magnitude which distinguishes between at least two conditions including a first condition indicating a sheet present in the gap and a second condition indicating a sheet adjacent to the lateral abutment.

4. A system for monitoring the side lays according to claim 3 wherein the single sensor is an optical sensor, and the optical sensor produces a signal having a magnitude proportional to the lateral position of the sheet.

5. A system for monitoring the side lays according to claim 3 wherein the single sensor is an optical sensor, and the optical sensor produces a signal having a magnitude inversely proportional to the lateral position of the sheet.

6. A system for monitoring the side lays according to claim 2 wherein the lateral sensing means includes a first sensor, and the excess draw sensing means includes a second sensor, the first sensor being located to detect a first condition indicating a sheet present within the minimum gap, and the second sensor being located to detect a second condition indicating a sheet adjacent to the lateral abutment.

7. A system for monitoring the side lays according to claim 3 wherein the control unit includes comparator means for evaluating the magnitude of the signal from the single sensor and in response thereto, providing a first signal indicative of a sheet present in the gap and a second signal indicative of no sheet present in the gap.

8. A system for monitoring the side lays according to claim 3 wherein the control unit includes a plurality of comparators associated with a plurality of reference levels for evaluating the magnitude of the signal from the single sensor and in response thereto, providing a first signal indicative of a sheet present in the gap, a second signal indicative of no sheet present in the gap, and a third signal indicative of a sheet adjacent the lateral abutment.

9. A method of monitoring side lay in a sheet-fed rotary press, the press having a feed table for supporting sheets being fed to the press, the method comprising the steps of:

feeding the sheet forward onto the feed table toward a forward abutment which establishes the forward position of the leading edge of the sheet, sensing the leading edge of the sheet to detect the sheet approaching the forward abutment, fixing the position of a lateral abutment and establishing a gap between the position of the lateral abutment and a minimum distance therefrom through which a sheet can be transversely shifted without substantial damage, detecting the side edge of the sheet to determine if it is within or without the minimum gap and, in dependence upon said detection performing one or the other of the following steps:

if the sheet is beyond the minimum gap at the time the leading edge engages the forward sensors, activating a transverse mechanism to convey the sheet against the lateral abutment, or if the sheet is within the minimum gap at the time the leading edge engages the forward sensors, taking corrective action including maintaining the transverse mechanism non-activated to prevent the sheet from being conveyed into and damaged by the lateral abutment.

10. The method of monitoring side lay according to claim 9 further comprising the step of:

detecting the sheet during its forward movement to determine if it will interfere with the lateral abutment and, in dependence on the detection performing one or the other of the following steps:

if the sheet will not interfere with the lateral abutment, allowing the sheet to continue to be fed forward, or if the sheet will interfere with the lateral abutment, taking corrective action including adjusting the position of the sheet so as to not interfere with the lateral abutment.

11. The method of monitoring side lay according to claim 10 including the step of:

detecting if the sheet is within or without the minimum gap and if the sheet will interfere with the lateral abutment by evaluating the magnitude of a signal produced by a single sensor.

* * * * *